US009113686B1

(12) United States Patent
Bishop

(10) Patent No.: US 9,113,686 B1
(45) Date of Patent: Aug. 25, 2015

(54) HOLDER ATTACHABLE TO A BOAT

(71) Applicant: Jerry W Bishop, Destin, FL (US)

(72) Inventor: Jerry W Bishop, Destin, FL (US)

( * ) Notice: Subject to any disclaimer, the term of this patent is extended or adjusted under 35 U.S.C. 154(b) by 0 days.

(21) Appl. No.: 14/311,306

(22) Filed: Jun. 22, 2014

Related U.S. Application Data

(63) Continuation-in-part of application No. 13/763,677, filed on Feb. 10, 2013, now Pat. No. 8,960,477, which is a continuation-in-part of application No. 12/803,949, filed on Jul. 12, 2010, now Pat. No. 8,371,548.

(51) Int. Cl.
*A45C 13/10* (2006.01)
*A45C 5/04* (2006.01)
*B63B 17/00* (2006.01)

(52) U.S. Cl.
CPC ..... *A45C 5/045* (2013.01); *B63B 17/00* (2013.01); *A45C 2013/1061* (2013.01)

(58) Field of Classification Search
USPC ..... 248/311.2, 313, 304, 339; 224/578, 224/579, 580, 584, 585, 269, 406, 565, 564, 224/566; 220/476, 480, 481, 485; 114/345; 211/88.01, 90.03, 106, 119, 119.006, 211/119.007; 190/122, 121, 115, 15.1, 107, 190/27
See application file for complete search history.

(56) References Cited

U.S. PATENT DOCUMENTS

2005/0274861 A1* 12/2005 Schaefer ..... 248/311.2

FOREIGN PATENT DOCUMENTS

GB 190301874 A * 0/1903
GB 190923394 A * 0/1909
GB 191105314 A * 0/1911

* cited by examiner

*Primary Examiner* — Alfred J Wujciak
(74) *Attorney, Agent, or Firm* — Peter Loffler

(57) ABSTRACT

A holding device is attachable to a rail, cleat, etc., of a boat or other object such that the holding device holds a cooler or similar objects without using up passenger space. The holding device is a flexible rectangular shaped basket member that has a rectangular rail strap onto the sides of which are attached latitudinal straps via closed loops thereon, and onto the ends of which are attached longitudinal straps also via closed loops. A relatively longer (compared to the rail strap) handle strap passes through the loops of the outer latitudinal straps and possibly the loops of longitudinal straps. The handle strap can be used to carry or support the basket and its cargo in a one handle or two handle configuration, or to secure the basket to an appropriate object such as a railing or a cleat.

14 Claims, 5 Drawing Sheets

HOLDER ATTACHABLE TO A BOAT

This application is a Continuation-In-Part of U.S. patent application Ser. No. 13/763,677 filed on Feb. 10, 2013, which is a Continuation-In-Part of U.S. patent application Ser. No. 12/803,949, filed on Jul. 12, 2010, now U.S. Pat. No. 8,371,548, each application and patent is incorporated by reference herein in its entirety.

BACKGROUND OF THE INVENTION

1. Field of the Invention

The present invention relates to a holder for ice chests and similar devices wherein the holder overhangs the side of a boat in order to save space on the boat and the holder can also be pulled or carried via onboard handles.

2. Background of the Prior Art

Boating is a popular pastime enjoyed by many, especially considering the fact that most Americans live a short driving distance from a navigable body of water. When the weather is agreeable, just load up the boat with fishing gear or other toys, food, drinks, and other whatnots, and then launch the boat for a fun filled day on the water. Although reasonable in size for their intended purpose, most boats, nevertheless, tend to be relatively small in size. Many factors dictate the need to keep boats relatively small including the costs of the boat, the high fuel consumption of a boat, the need to be able to tow the boat to the launch site, and the need to store the boat, among others. While even a small boat can be quite fun and relaxing, certain tradeoffs must be made. With several people on board a relatively small boat, precious little real estate, both deck space and seating space, remains for other items such as bait holders, coolers, picnic baskets, etc, items which are considered essential for all but the shortest of boat rides. Placing such items onto the boat crowds the deck and makes it more difficult for the passengers to move around. While many boats have below deck storage areas, such storage areas are often difficult to access and require the passengers to crowd to one section of the boat, which can be quite uncomfortable, especially when the outside temperatures are very hot.

What is needed is a device that allows boat captains to be able to take coolers and other items aboard a boat without sacrificing the relatively scarce deck space and seating areas aboard the boat. Such a device must allow quick and easy access to the items being held by the device without imposing an undue burden upon the boat's passengers. Ideally such a device should be of relatively simple design and construction and be easy to install, operate, and maintain.

SUMMARY OF THE INVENTION

The holder attachable to a boat of the present invention addresses the aforementioned needs in the art by providing a holder that is capable of holding typical coolers as well as various other items on board a boat without the need to take up any deck or seating real estate of the boat. The holder attachable to a boat allows for quick and easy access to the items being held therein without the need to herd the passengers to a particular section of the boat. The holder attachable to a boat is of relatively simple design and construction so as to be relatively inexpensive to manufacture making the device economically affordable to a large portion of the boat owning consumers. The holder attachable to a boat is relatively easy to install upon the boat, is easy to operate, and to maintain. The holder attachable to a boat has the added feature of having a carrying handle system built in.

The holder attachable to a boat of the present invention is comprised of a basket member that has a generally rectangular-shaped top rail strap (with rounded corners) with a first end edge and an opposing second end edge joined by a first side edge and an opposing second side edge. A pair of first straps (longitudinal straps) is provided such that each first strap has a pair of opposing first ends each first end formed as a closed first loop. One first loop of these first straps is attached to the first end edge and one first loop (the first loop on the opposing end of the first strap) is attached to the second end edge of the top rail strap. A series of second straps (latitudinal straps) is provided such that each second strap has a pair of opposing second ends each second end formed as a closed second loop. One second loop of each of these second straps is attached to the first side edge and one second loop (the second loop on the opposing end of the second strap) is attached to the second side edge of the top rail strap. The top rail strap has a first circumferential length. A closed loop handle strap passes through each second closed loop of the latitudinal strap that is closest to the first side edge of the top rail strap and through each second closed loop of the latitudinal strap that is closest to the second side edge of the top rail strap. The handle strap has a second circumferential length that is greater relative to the first circumferential length of the top rail strap. The handle strap may also pass through each first closed loop of each longitudinal strap. The longitudinal straps are coextensive with one another while the latitudinal straps are coextensive with one another. Whenever a longitudinal strap crosses a latitudinal strap at a cross point, the longitudinal strap is fixedly attached to the latitudinal strap at the cross point. A securement strap may be used, especially with heavy cargo, such that the securement strap has a pair of third ends such that each third end is removably attached to the holding strap in spaced apart fashion, passing underneath the basket member to help support cargo held within the basket member. An attachment ring may be attached to a second closed loop. The second circumferential length of the handle strap is adjustable via an adjustment buckle located along the handle strap.

BRIEF DESCRIPTION OF THE DRAWINGS

Similar reference numerals refer to similar parts throughout the several views of the drawings.

DESCRIPTION OF THE PREFERRED EMBODIMENT

Figure 1:
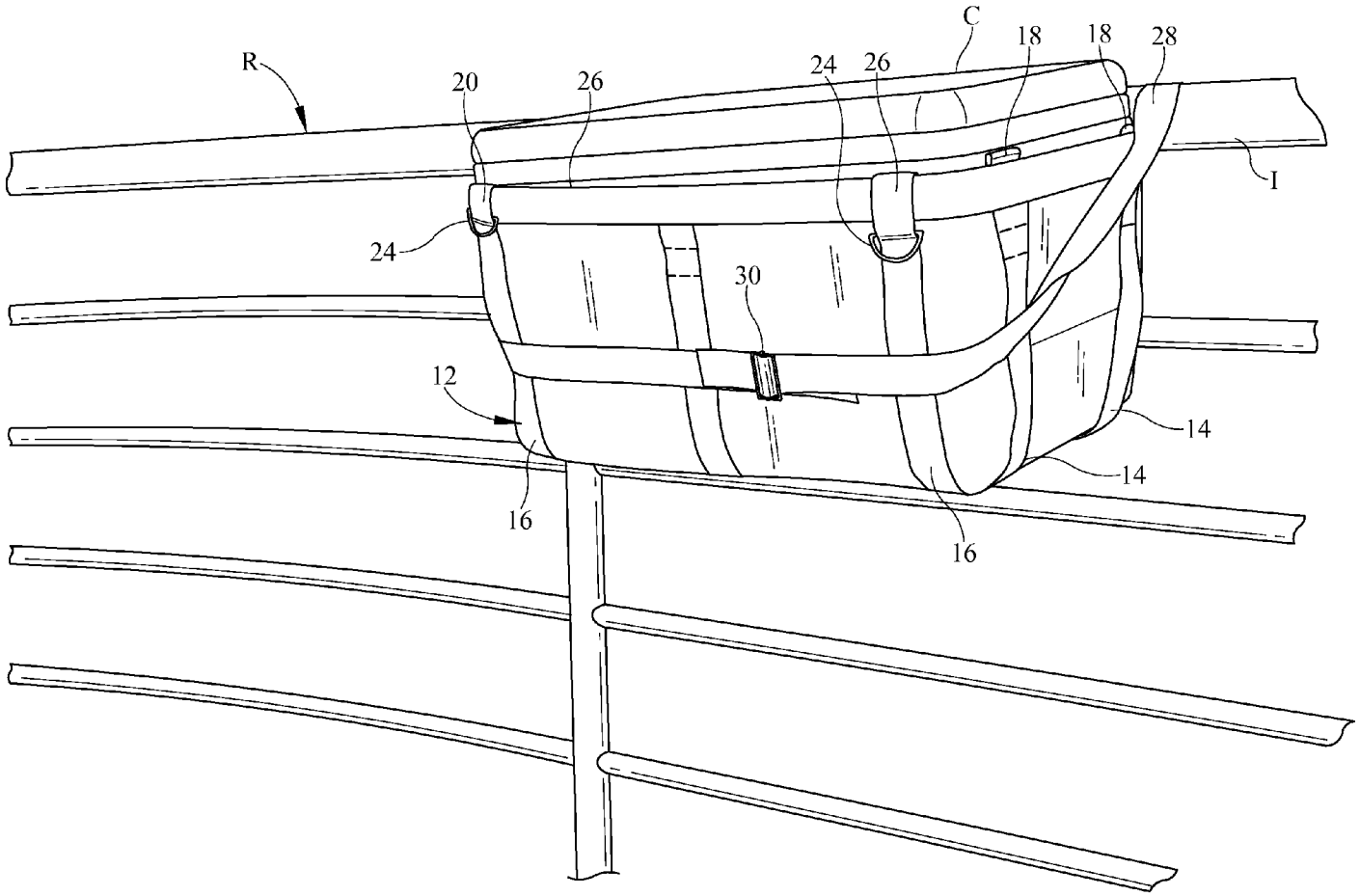
FIG. 1 is an environmental view of the holder attachable to a boat of the present invention attached to a railing.

Referring now to the drawings, it is seen that the holder attachable to a boat of the present invention, generally denoted by reference numeral 10, is comprised of a basket 12.

As seen, the basket 12 is generally rectangular in shape and has a pair of longitudinal straps 14 joined perpendicularly by two or more latitudinal straps 16. As seen, a closed first loop 18 is located on each end of each of the longitudinal straps 14 while a closed second loop 20 is located on the end of each latitudinal strap 16. Each first loop 18 and each second loop 20 is formed by looping the end of the respective strap 14 and 16 onto itself and securing the end to the respective strap 14 and 16 in appropriate fashion such as via the illustrated stitching 22, adhesion, etc. As seen, an attachment ring 24 is located within the loop 20 of each outer latitudinal strap 16—of course, additional attachment rings can be located in the other loops 18 or 20 as desired.

Each longitudinal straps 14 can be secured to each latitudinal strap 16 at their overlap points in appropriate fashion (stitching, adhesion, etc.,), the two straps 14 and 16 crossing each other in approximately perpendicular fashion.

A top rail strap 26, which is a closed loop, is secured to each first loop 18 and each second loop 20 in appropriate fashion such as by passing the top rail strap 26 through each loop 18 and 20 in order, possibly securing the top rail 26 within each such loop 18 and 20 in appropriate fashion (stitching, adhesion, etc.,), or by securing the top rail 26 to the inner surface of each loop 18 and 20 in appropriate fashion (stitching, adhesion, etc.,), as illustrated.

The top rail strap 26 forms the upper rim of the basket 12 while the longitudinal straps 14 and latitudinal straps 16 form the body of the basket 12. Netting (not illustrated) can be located within the basket 12 in order to allow relatively small objects to be held by the basket 12.

Figure 5:
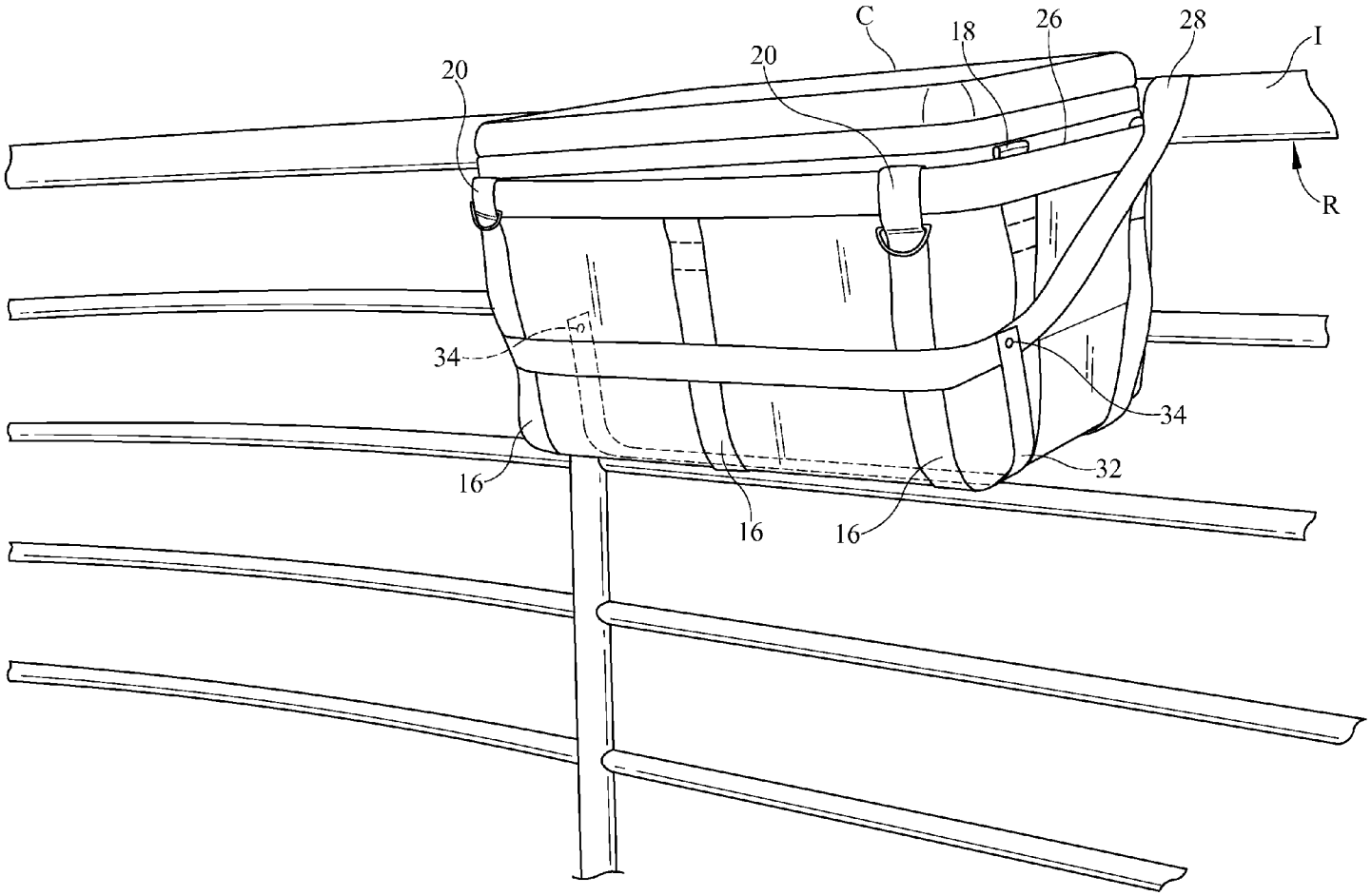
FIG. 5 is an environmental view of the holder attachable to a boat attached to a railing using an optional snap on support strap.

A handle strap 28 passes through the first closed loops 18 of each of the longitudinal straps 14 and each closed loop 20 of the outer latitudinal straps 16, although the handle strap 28 need not necessarily pass through the closed loops 18 of the longitudinal straps 14, see FIGS. 1 and 5. The handle strap 28, which may but need not necessarily have a size adjustment buckle 30 and which is also a closed loop, is substantially circumferentially longer relative to the circumferential length of the top rail strap 26.

The longitudinal straps 14, the latitudinal straps 16, the top rail strap 26, and the handle strap 28 are all preferably made from an appropriate flexible material such as Nylon, etc., (at least the handle strap 28 is so made for ease of attachment of the basket 12 to a target surface such as the illustrated railing R).

Figure 2:
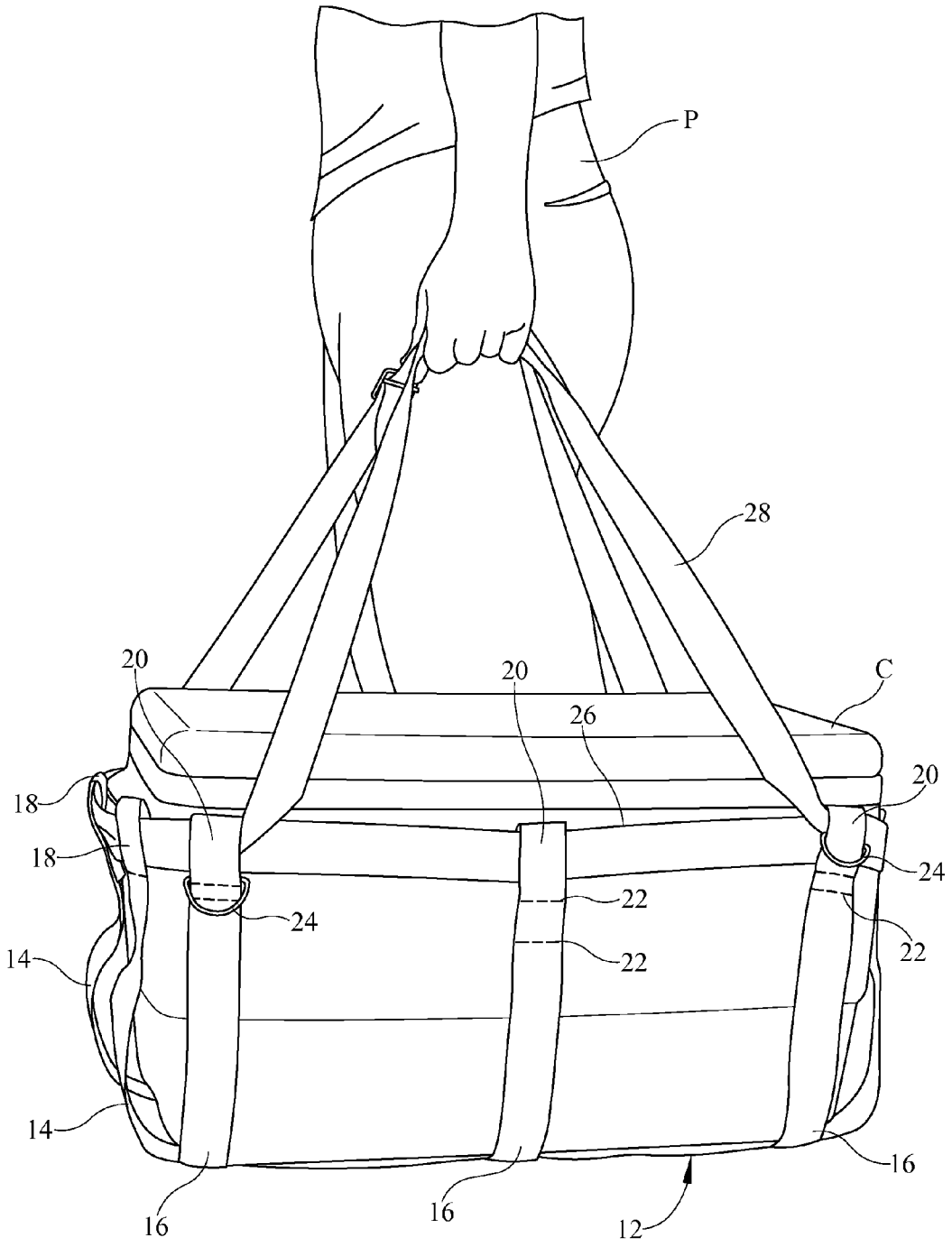
FIG. 2 is a side perspective view of the holder attachable to a boat being carried using a dual handle strap configuration.
Figure 3:
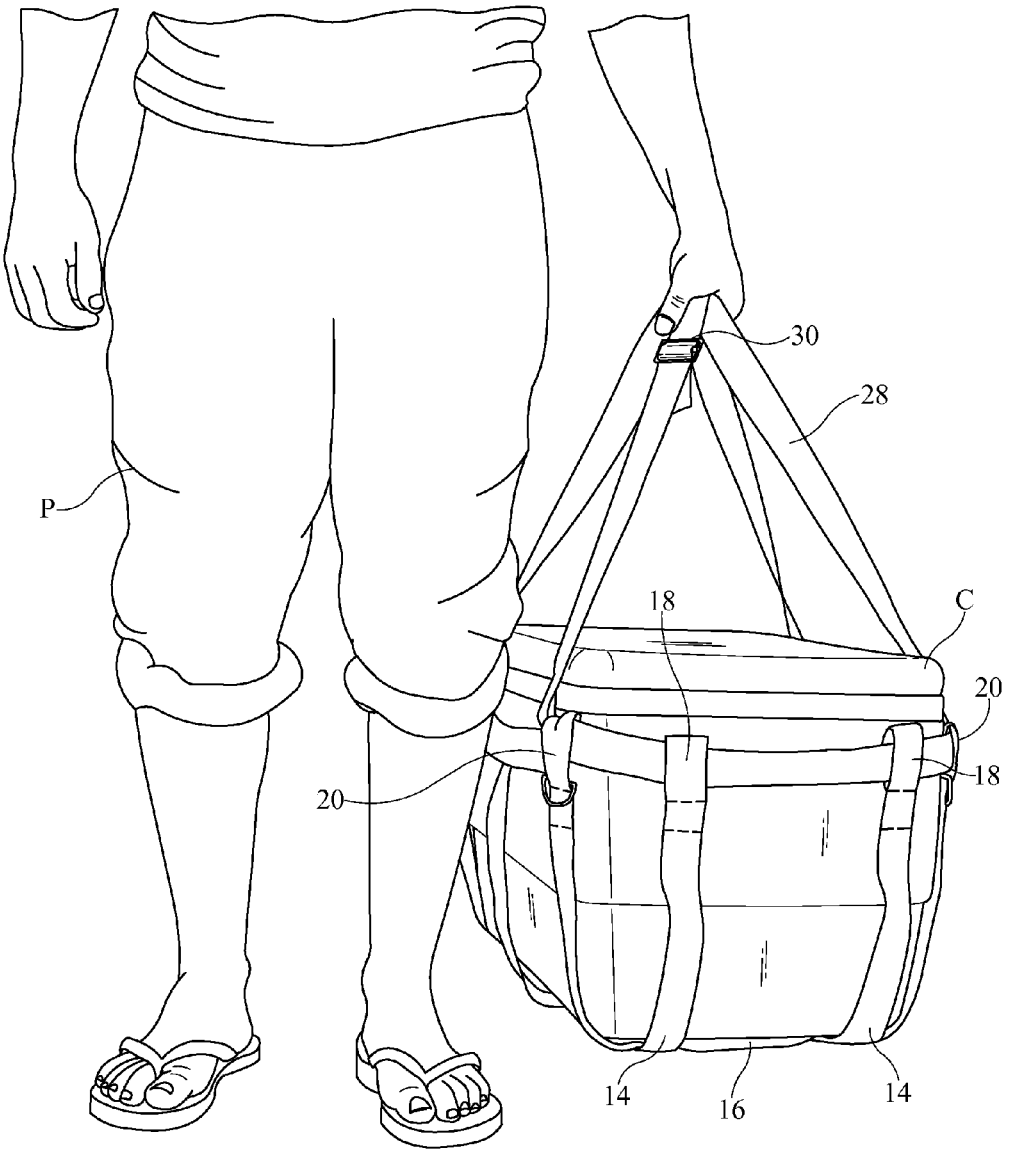
FIG. 3 is a front perspective view of the holder attachable to a boat being carried using a dual handle strap configuration.
Figure 4:
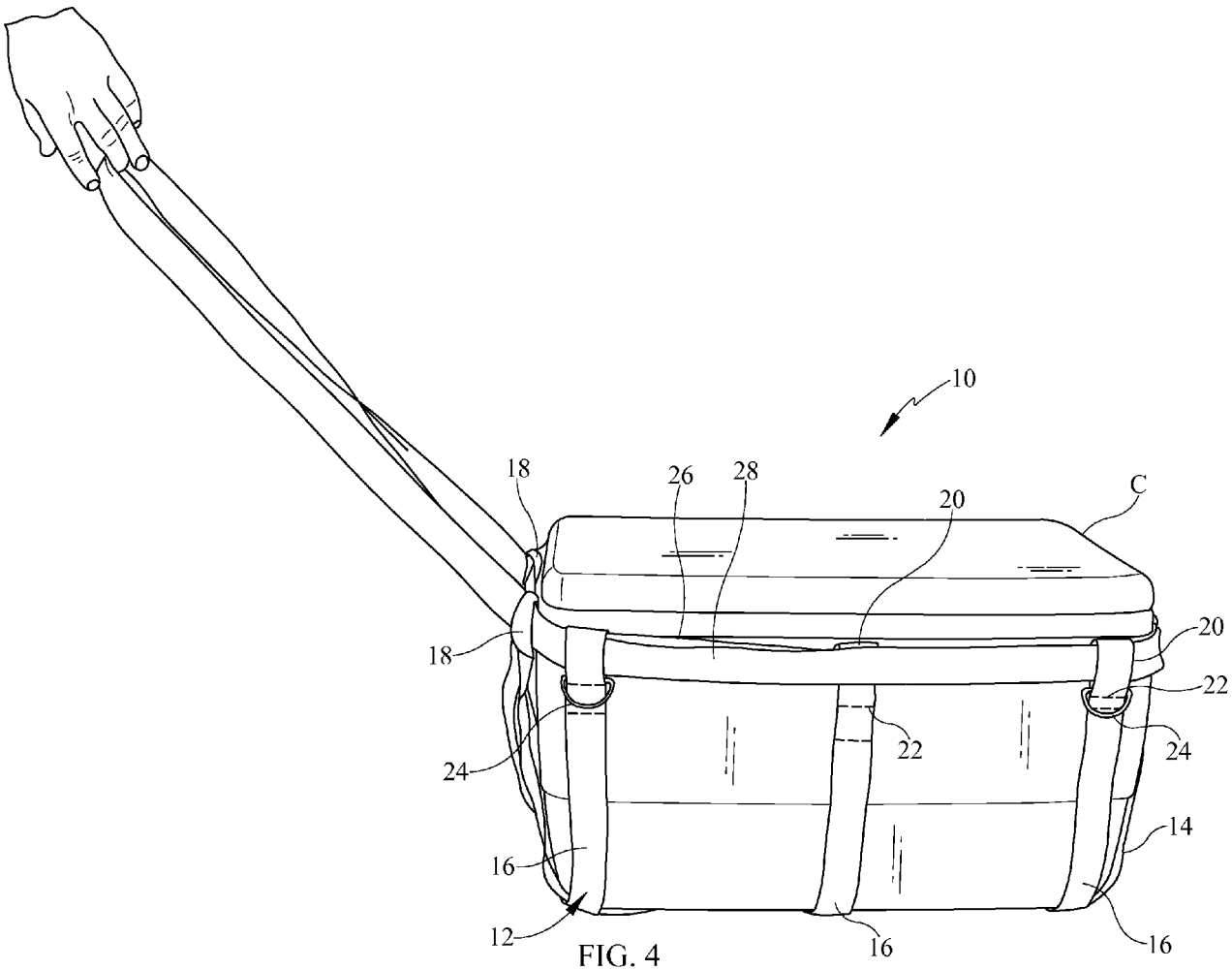
FIG. 4 is a side perspective view of the holder attachable to a boat being carried using a single handle strap configuration.

In order to use the holder attachable to a boat 10 of the present invention, a cooler C or other appropriate object is placed into the basket 12. Thereafter, the basket 12 is maneuvered via the handle strap 28. Such maneuvering can take the form of carrying the basket 12 via the handle strap 28 in a two handle configuration, as illustrated in FIGS. 2 and 3, by having the user P grasp the handle strap 28 at two points, one point being on one side of the basket 12 proximate the inner latitudinal strap 16 (or the proximate central point of this side of the basket if there is more than one inner latitudinal strap), the other point being on the opposing side of the basket 12 proximate the opposing end of the inner latitudinal strap 16. As the handle strap 28 is longer relative to the length of the top rail strap 26, there is excess strap material of the handle strap 28 forming a pair of carrying handles as shown—of course the basket 12 can be hung onto an appropriate object such as a boat cleat (not illustrated) in this configuration. By so carrying the basket 12 in this configuration, the handle strap 28 also cinches the top rim of the basket 12 about the cooler C. Alternately, the handle strap 28 can be used in a single handle configuration as illustrated in FIG. 4. In such a configuration, the handle strap 28 is grasped approximately medially between the ends of the longitudinal straps 14 on either end of the basket 12. As the handle strap 28 is longer relative to the length of the top rail strap 26, there is excess strap material of the handle strap 28 forming a carrying handle at the end of the basket 12 as shown. The basket 12 and its cargo C can be pulled along in this configuration—of course the basket 12 can be hung onto an appropriate object such as a boat cleat (not illustrated) in this configuration. As a further alternative, the basket 12 and its cargo C can be secured to a target object such as the railing R as illustrated in FIGS. 1 and 5. To do so, the excess handle strap 28 length is pulled out from one side of the basket 12. This excess length is passed underneath one of the rails I of the railing R and passed back over top this same rail I and thereafter fitted about the other side of the basket 12 and the cargo C being held, approximately half way up the basket 12. The adjustment buckle 30 is used to tighten the handle strap 28 and cinch the handle strap 28 securely in place. If needed for extra support, a support strap 32 has each of its ends removably secured to the handle strap 28, the support strap 32 passing underneath the basket 12 and its cargo C. Removable attachment of the support strap 32 to the handle strap 28 can be accomplished in any appropriate fashion such as via the illustrated snaps 34, cooperating sections of hook and loop material, etc. The support strap 32 can be made from the same or similar material used to make the other various straps of the holder attachable to a boat 10

While the invention has been particularly shown and described with reference to an embodiment thereof, it will be appreciated by those skilled in the art that various changes in form and detail may be made without departing from the spirit and scope of the invention.

I claim:

1. A holding device comprising:

a basket member having a generally rectangular-shaped top rail strap with a first end edge and an opposing second end edge, the first end edge and the second edge joined by a first side edge and an opposing second side edge, a pair of first straps, each having a pair of opposing first ends with each first end formed as a closed first loop, one first loop attached to the first end edge and the other first loop attached to the second end edge of the top rail, and a second series of straps, each having opposed second ends with each second end formed as a closed second loop, one second loop attached to the first side edge and the other second loop attached to the second side edge of the top rail strap, the top rail strap having a first circumferential length; and a closed loop handle strap passing through each second loop of the second strap that is closest to the first side edge of the top rail strap, the handle strap also passing through each second loop of the second strap that is closest to the second side edge of the top rail strap, such that the handle strap has a second circumferential length that is greater relative to the first circumferential length of the top rail strap.

2. The holding device as in claim 1 wherein the handle strap also passes through each first closed loop.

3. The holding device as in claim 2 wherein the first straps are coextensive with and spaced apart from one another and the second straps are coextensive with and spaced apart from one another.

4. The holding device as in claim 3 wherein whenever a longitudinal strap crosses a latitudinal strap at a cross point, the longitudinal strap is fixedly attached to the latitudinal strap at the cross point.

5. The holding device as in claim 4 further comprising a securement strap having a pair of third ends such that each third end is removably attached to the handle strap.

6. The holding device as in claim 5 further comprising an attachment ring attached to a second closed loop.

7. The holding device as in claim 6 wherein the second circumferential length of the handle strap is adjustable.

8. The holding device as in claim 6 further comprising an adjustment buckle located along the handle strap, the adjustment buckle used to vary the second circumferential length of the handle strap.

9. The holding device as in claim 1 wherein the longitudinal straps are coextensive with and spaced apart from one another and the latitudinal straps are coextensive with and spaced apart from one another.

10. The holding device as in claim 9 wherein whenever a longitudinal strap crosses a latitudinal strap at a cross point, the longitudinal strap is fixedly attached to the latitudinal strap at the cross point.

11. The holding device as in claim 1 further comprising a securement strap having a pair of third ends such that each third end is removably attached to the handle strap.

12. The holding device as in claim 1 further comprising an attachment ring attached to a second closed loop.

13. The holding device as in claim 1 wherein the second circumferential length of the handle strap is adjustable.

14. The holding device as in claim 1 further comprising an adjustment buckle located along the handle strap, the adjustment buckle used to vary the second circumferential length of the handle strap.

* * * * *